United States Patent [19]

Young et al.

[11] 4,306,322

[45] Dec. 22, 1981

[54] PNEUMATIC BED ASSEMBLY

[75] Inventors: Gary A. Young, LaMoure, N. Dak.; Emil S. Swenson, Coon Rapids, Minn.

[73] Assignee: Dial-A-Firm, Inc., LaMoure, N. Dak.

[21] Appl. No.: 94,347

[22] Filed: Nov. 14, 1979

Related U.S. Application Data

[63] Continuation-in-part of Ser. No. 951,595, Oct. 16, 1978, Pat. No. 4,224,706.

[51] Int. Cl.[3] ..... A47C 27/08

[52] U.S. Cl. ..... 5/449; 5/455; 5/458; 297/284

[58] Field of Search ..... 5/447, 449–456, 5/458, 462, 470, 490; 297/284

[56] References Cited

U.S. PATENT DOCUMENTS

| | | | |
|---|---|---|---|
| 954,284 | 4/1910 | Hecht | 5/458 |
| 2,000,873 | 5/1935 | Arens | 5/453 |
| 2,136,510 | 11/1938 | Jensen | 5/462 |
| 2,682,673 | 7/1954 | Myers | 5/490 |
| 2,769,182 | 11/1956 | Nunlist | 5/452 |
| 2,814,053 | 11/1957 | Sevcik | 5/455 |
| 2,823,394 | 2/1958 | Smith | 5/455 |
| 3,059,249 | 10/1962 | Kamp | 5/464 |
| 3,551,924 | 1/1971 | Frye, Sr. | 5/447 |
| 3,784,994 | 1/1974 | Kery | 5/456 |
| 3,879,598 | 4/1975 | Darling | 5/452 |

*Primary Examiner*—Casmir A. Nunberg

[57] ABSTRACT

A bed assembly (10*a*) is disclosed. The bed assembly (10*a*) includes an air mattress (32*a*) for supporting a human body in a generally prone position. The air mattress (32*a*) has an overall firmness determined by the amount of air in the air mattress. A port for admitting and releasing air to and from the air mattress (32*a*) is formed through the air mattress (32*a*). A box spring support structure (12*a*) holds the air mattress above a surface. A mechanism (44*a*) is provided for adjusting the overall firmness of the air mattress (32*a*) by adjusting the amount of air pressure in the air mattress (32*a*). The adjusting mechanism (44*a*) includes a bladder or balloon (48*a*–54*a*) for containing a quantity of air and a mechanism (56*a*) for transferring air between the air mattress (32*a*) and the bladder (48*a*–54*a*) to adjust the relative volume of the air mattress and the bladder. The adjusting mechanism (44*a*) sets the internal volume of the bladder (48*a*–54*a*) at a desired volume in order to set the relative quantity of air between the air mattress (32*a*) and the bladder (48*a*–54*a*) and total volume of the combined air mattress (32*a*) and bladder (48*a*–54*a*).

31 Claims, 15 Drawing Figures

PNEUMATIC BED ASSEMBLY

BACKGROUND OF THE INVENTION

This patent application is a continuation-in-part of an earlier application, Ser. No. 951,595 filed Oct. 16, 1978, now U.S. Pat. No. 4,224,706.

The present invention relates broadly to a bed assembly which utilizes an air mattress for at least a portion of the body supportive surface of the bed. More specifically, the present invention relates to a bed assembly wherein the overall firmness of the air mattress can be adjusted.

Mattresses which utilize air-filled bags or cores are known in the prior art. For example, U.S. Pat. Nos. 954,284 to Hecht; 2,000,873 to Arens; and 2,823,394 to Smith each discloses a mattress, a portion of which is filled with air. In the mattresses disclosed in Arens and Smith a central air-filled core is surrounded by padding material.

Bed assemblies which utilize air mattresses and which have some control mechanism to adjust the inflation of the air mattress are also known in the prior art. Examples of such bed assemblies are illustrated in U.S. Pat. Nos. 3,605,138 to Tucker; 3,784,994 to Kery; and 3,822,425 to Scales. Such inflation control mechanisms, however, have generally been complex and utilized valving and/or compressor mechanisms, or individual cell systems. Applicants are unaware of a simple and inexpensive firmness control mechanism for use with an air mattress used in a bed assembly.

U.S. Pat. No. 3,792,501 to Kery, hereinafter Kery '501 patent, discloses several embodiments of air chairs and convertible sofas. The chairs and sofas of the Kery '501 patent utilize air mattress type cushions. Each cushion communicates with an air spring and a specified quantity of air is filled within a respective cushion and air spring. The air springs are spring biased to a collapsed position so that when no pressure is applied to the cushions, the air springs remain completely collapsed. However, when pressure is applied to a cushion, air is forced into and extends the air spring. The firmness of a cushion thus adjusts to the pressure applied. However, a mechanism for adjusting and setting the firmness as disclosed in the present invention is not provided.

Other complex air cushions and air inflation mechanisms for use in automobile seats are disclosed in U.S. Pat. Nos. 2,136,510; 3,326,601; and 3,363,941.

SUMMARY OF THE INVENTION

The present invention relates to a bed assembly. The bed assembly includes an air mattress for supporting a human body. The air mattress has an overall firmness determined by the quantity of air in the air mattress. The air mattress has a port for admitting and releasing air to and from the air mattress. A box spring is provided for resiliently supporting the air mattress above a surface. Means for adjusting the overall firmness of the air mattress by adjusting the amount of air in the air mattress is provided. The adjusting means includes at least one chamber defining a variable internal volume for containing a varible quantity of air; conduit means connecting the chamber with the port of the air mattress for fluid communication between the chamber and the air mattress; and means for changing the internal volume of the chamber and for setting the internal volume at a desired internal volume whereby a desired overall air mattress firmness is established by adjusting and setting the relative quantity of air in the air mattress and in the chamber.

In the preferred embodiment, a plurality of the chambers are utilized and, preferably, the chambers are formed of flexible walled bladders or balloons. The balloons can be supported within a housing below the air mattress. One of the walls of the housing, preferably the top wall, is moveable relative to the other walls of the housing. In this manner, pressure can be applied to the balloons to force air from the balloons to the air mattress. By forcing more air into the air mattress, the overall firmness of the air mattress is increased, while conversely allowing more air to be contained in the balloons decreases the overall firmness of the air mattress.

A scissor jack can be used to move the top wall of the housing upwardly and downwardly. When a scissor jack is used, a means for indicating the overall firmness can be coupled to the scissor jack to indicate the relative location of the top plate and, hence, the amount of air forced into the air mattress. In this manner, the overall firmness of the air mattress can be indicated. The indicating means preferably includes a pair of microswitches activated by a nut or runner secured to an upper end of a linkage arm of the scissor jack. The microswitches control current flowing through a plurality of indicating lights supported on an edge of the bed assembly. The indicating lights provide visual indication of the relative overall firmness of the air mattress.

In one embodiment of the invention, a pair of air mattresses is used in the bed assembly. Each of the air mattresses has its own firmness adjusting mechanism. In another embodiment, one of the two air mattresses is replaced by a conventional foam or spring type mattress. In another embodiment, one of the two air mattresses is replaced by a waterbed type of mattress. Thus, the firmness and type of sleeping surface can be suited to the personal taste of two individuals.

Various advantages and featuures of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there are illustrated and described certain preferred embodiments of the invention.

DETAILED DESCRIPTION OF THE DRAWINGS

Figure 1:
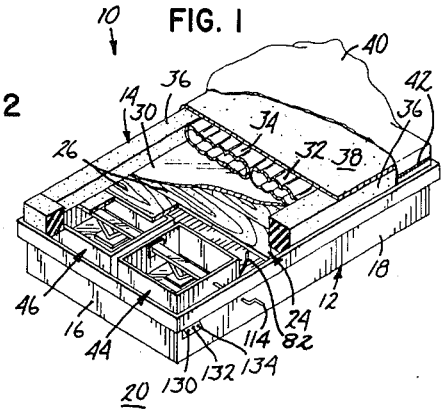
FIG. 1 is a perspective view, partially broken away, illustrating a bed assembly in accordance with the present invention.

Referring to the drawings in detail, wherein like numerals indicate like elements, there is shown in FIG. 1 a bed assembly in accordance with the present invention designated generally as 10. The bed assembly 10 includes a support structure 12 and a body supporting section 14. The support structure includes four outer walls interconnected in a rectangular configuration. Two outer walls, 16 and 18, are shown in the Figures. The outer walls each have a lower edge adapted to rest upon a support surface 20.

The support structure 12 may also include a base 22 connected to the lower edges of the outer walls. A platform 24 for supporting the body support section 14 is carried by the support structure 12. The platform 24 is preferably made of a plurality of individual planks 26. The planks 26 are relatively narrow as compared to the length of the entire platform 24. In this manner, a few of the planks 26 can be individually moved to gain access to the area of the support structure 12 below the platform 24. The planks 26 are removably held to the remaining portion of the support structure 12 by a suitable means, such as support beams 28 attached to the inner surfaces of the outer walls. See FIGS. 2 and 3 wherein two of the support beams 28 are shown. The support beams 28 extend around the entire perimeter of the outer walls.

The body supporting section 14 preferably includes a sheet of resilient material 30, a first air mattress 32, a second air mattress 34, soft resilient material 36, a second sheet of resilient material 38, and a cover member 40. The sheet of resilient material 30 is supported above the platform 24. The first and second air mattresses 32, 34 are thereafter supported upon the sheet 30. The air mattresses 32, 34 are conventional in construction and preferably have a four-sided rectangular configuration. The mattresses 32, 34 are arranged in a side-by-side relationship wherein one lateral side of the first air mattress 32 is disposed adjacent one lateral side of the second air mattress 34. A perimeter boundary around the two air mattresses 32, 34 is formed by the other lateral sides and both of the top sides and both of the bottom sides of the air mattresses 32, 34. The soft resilient material 36 is supported atop the sheet 30 and surrounds the perimeter boundary of the first and second air mattresses 32, 34. The resilient material 36 is preferably made of four longitudinally extending blocks of material, such as foam rubber. The second sheet of resilient material 38 rests on top of the soft resilient material 36 and on top of the two air mattresses 32, 34. The sheets 30, 38, the air mattresses 32, 34 and the soft resilient material 36 are all received within the cover member 40. The cover member 40 has a zipper 42 extending around at least a portion of its length so that the cover member 40 may be readily removed.

Each air mattress 32, 34 is connected respectively to a discrete means 44, 46 for adjusting the overall firmness of the respective air mattresses 32, 34. Since the air mattresses 32, 34 and the firmness adjusting means 44, 46 are identical, only the air mattress 32 and the associated firmness adjusting means 44 will be described hereinafter in detail.

The firmness adjusting means 44 includes a plurality of flexible balloons or bladders 48, 50, 52, and 54 in fluid communication with the air mattress 32 via a conduit means 56. The balloons 48–54 are made of a strong flexible material capable of withstanding the pressures which will be exerted upon them. A plurality of balloons is utilized so that the total pressure will not be exerted upon any single balloon. The conduit means 56 includes an inlet-outlet tube 58 in fluid communication with a port 60 of the balloon 48 and an inlet-outlet tube 62 connected in fluid communication with a port 64 of the balloon 50. A Y-connector 66 connects the tubes 58, 62 to an intermediate tube 68. Balloons 52, 54 are similarly connected in fluid communication to an intermediate tube 70 via inlet-outlet tubes 72, 74, ports 76, 78 and a Y-connector 80. The intermediate tubes 68, 70 are connected to a transfer tube 82 via a Y-connector 84. A Y-connector 86 couples a branch inlet tube 88 to the transfer tube 82. The branch inlet tube 88 is used to fill both the balloons 48–54 and the air mattress 32 with a specified quantity of air. Thereafter the end of the branch tube 88 is sealed by any suitable means, such as cap 90. In order to provide fluid communication between the balloons 48–54 and the air mattress 32, the transfer tube 82 is connected to the air mattress 32 via a port (not shown) in the air mattress 32.

Figure 2:
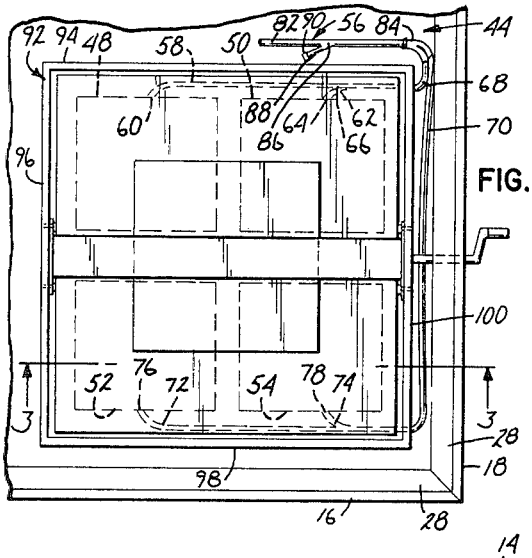
FIG. 2 is a top plan view on an enlarged scale of a mechanism for adjusting the overall firmness of an air mattress.
Figure 3:
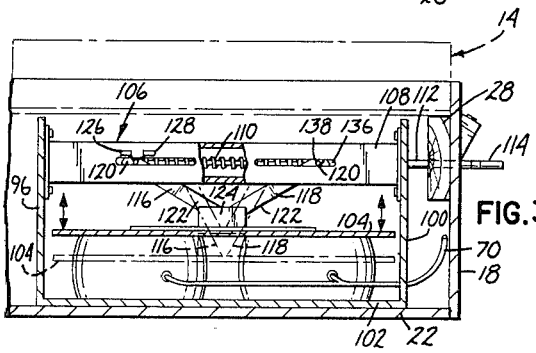
FIG. 3 is a view taken along lines 3—3 of FIG. 2.

The balloons 48–54 define chambers having variable internal volumes. When pressure is applied to the balloons 48–54, air is forced from the balloons 48–54, through the conduit means 56, and into the air mattress 32. In this manner, the overall firmness of the air mattress 32 is increased. If the internal volume is held after the pressure is applied, the firmness remains at a set value. FIGS. 2 and 3 illustrate in detail a preferred pressure application means that is capable of holding the balloons 48–54 at a set internal volume.

The balloons 48–54 are held within a housing 92. The housing 92 includes four upright side walls 94, 96, 98 and 100, a base plate or wall 102 and a top plate or wall 104. In order to apply pressure to the balloons 48–54, one of the walls 94–104 is movable with respect to the other walls 94–104. Preferably the top wall 104 is made movable upwardly and downwardly with respect to the base wall 102.

A scissor jack 106 is used to move the top wall 104 upwardly and downwardly. The scissor jack 106 has a support bar 108 which has opposite ends connected to the side walls 96 and 100. A screw 110 is rotatably carried by the support bar 108. A rod 112 is attached to one end of the screw 110 for rotary motion therewith. The rod 112 extends outwardly of the outer wall 18 and has a handle 114 fixed to its distal end. By cranking the handle 114, the rod 112 and the screw 110 can be rotated. A pair of linkage arms 116, 118 are drivingly coupled to the screw 110. Each linkage arm 116, 118 has a first end 120 coupled to the screw 110 and a second end 122 pivotably connected to a block 124. The block 124 is fixedly secured to the top wall 104. The rotation of the screw 110 causes the ends 120 to move along the longitudinal axis of the screw 110 toward and away from one another. This causes the second end 122 to pivot within the block 124 and to thereby move the top wall 104 upwardly and downwardly. The top plate 104 and the linkage arms 116, 118 are shown in an upward disposition in full line in FIG. 3 and in a lower disposition in phantom line in FIG. 3. An electric motor can be coupled to the rod 112 in place of the handle 114. Such an electric motor could be supported within or outside of the support structure 12. A motorized, instead of a manual, firmness adjusting means would thus be provided.

Figure 4:
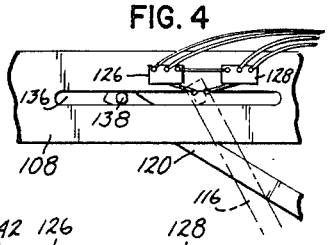
FIG. 4 is an elevational view on an enlarged scale of a portion of the scissor jack and attached microswitches.

By moving the plate 104 upwardly and downwardly, the set quantity of air within the balloons 48–54 and the air mattress 32 can be transferred therebetween. The overall firmness of the air mattress 32 can thereby be adjusted. Since the scissor jack 106 will hold the top wall 104 in a set position, the overall firmness of the air mattress 32 is also set. Means are provided for indicating the relative overall firmness of the air mattress 32. The means includes a pair of microswitches 126, 128 and a series of lights 130, 132 and 134. As will be explained below, the microswitches 126, 128 and lights 130–134 are used to sense and indicate the vertical position of the top plate 104 and, hence, the overall firmness of the air mattress 32. As is best seen in FIG. 4, the microswitches 126, 128 are mounted to the support bar 108 adjacent a longitudinally extending slot 136 formed therein. A nut or slide member 138 is secured to the first end 120 of the linkage arm 116. The nut 138 is slidably received within the slot 136 to guide the first end 120 along the length of the screw 110. A similar slot 136 is provided on the other side of the support bar 108 and a similar nut or slide member 138 is secured to the first end 120 of the other linkage arm 118. The nut 138 of the linkage arm 118 is slidably received within the respective slot 136.

Figure 8:
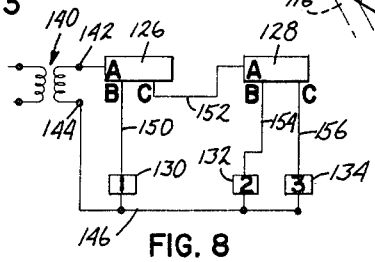
FIG. 8 is a schematic diagram illustrating a circuit used with the firmness indicator mechanism.

A circuit diagram which illustrates the connection of the microswitches 126, 128 and the lights 130–134 to an electrical source is shown in FIG. 8. A low voltage transformer 140 is connected to an electrical source (not shown) and provides current to the illustrated circuit. A DC battery can be substituted for the transformer 140, so that the circuit need not be connected to house current. A switch can be interposed between the electrical source or the DC battery and the remainder of the circuit, so that the indicator means can be turned on and off as desired. A first terminal 142 of the transformer 140 is connected to an input terminal A of the first microswitch 126. A second terminal 144 of the transformer 140 is connected to a common lead or conductor 146 which is connected to one side of each of the first, second and third lights 130, 132, 134. Both of the microswitches 126, 128 are normally closed microswitches, each having an actuator arm 148. The microswitches 126, 128 each have a normally closed output terminal B and an output terminal C through which current passes when the respective actuator arm 148 is activated.

When the plate 104 is in an upward disposition and the nut 138 is disposed to the left of the slot 136 it does not engage either of the actuator arms. In such a position, a circuit is complete through the terminal 142, the input lead A of microswitch 126, through the normally closed output terminal B of the microswitch 126, through a conductor 150 to the first light 130 and through the common lead 146 to the second terminal 144 of the transformer 140. The first light 130 thus indicates relatively soft firmness of the air mattress 32. As the top plate 104 is moved downwardly, the nut 138 moves to the right and engages the actuator arm 148 of the first microswitch 126. The microswitch 126 thus moves from its normally closed position to a position wherein current passes through output terminal C. In this manner, the circuit through the first light 130 is opened and the circuit is completed through the second light 132 through the second microswitch 128 via the terminal C of the microswitch 126, a lead or conductor 152, the input terminal A of the second microswitch 128, output terminal B of microswitch 128, a conductor or lead 154 to the second light 132, and then through the common lead 146 to the second terminal 144 of the transformer 140. An intermediate level of firmness is thus indicated by the second light 132. As the top plate is moved further downwardly, the nut 138 moves further to the right and engages both of the actuator means 148. Both of the microswitches 126, 128 are moved from their normally closed modes and current flows through both output leads C. The circuit through the second light 132 is thus opened and the circuit through the third light 134 is completed through the output terminal C of the second microswitch 128, a conductor or lead 156 which connects the terminal C of microswitch 128 with the light 134, and through the common lead 146 to the second terminal 144 of transformer 140. In this position, the plate 104 is in its lowermost position and the third light indicates that the air mattress 32 is in its firmest condition.

Figure 7:
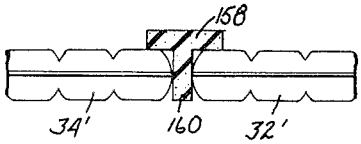
FIG. 7 is an end view, partially in section, illustrating a pair of mattresses with a resilient spacer disposed between the two air mattresses.

FIG. 7 illustrates a manner of expanding the bed assembly 10 to a larger size of bed, such as a conventional king size bed. A strip of resilient soft material 158, which has a generally T-shaped cross section, is used. The upright section 160 of the T-shaped cross-section is interposed between the two air mattresses 32', 34'. Additional sheets of resilient material can be placed on the air mattress 32', 34' to form a continuous surface with the strip 158. In this manner, the two air mattresses 32', 34' are spaced apart and a continuous soft body support area is provided which covers an expanded surface area.

Figure 5:
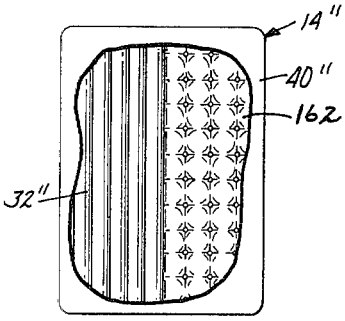
FIG. 5 is a top plan view, partially broken away, illustrating a further embodiment of the invention.

FIG. 5 illustrates another embodiment of the present invention. The body supporting section 14'' utilizes only a single air mattress 32''. In place of the other air mattress, a standard mattress 162 is used. The mattress 162 may be either a box spring type or a foam type.

Figure 6:
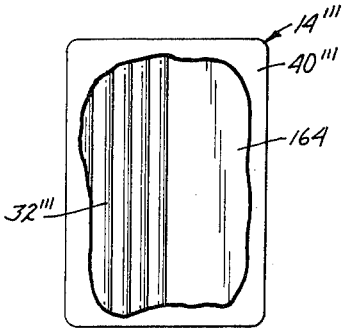
FIG. 6 is a top plan view, partially broken away, illustrating a further embodiment of the invention.

Another embodiment of the present invention is illustrated in FIG. 6. In the body supporting section 14''' only a single air mattress 32''' is used. In place of the other air mattress, a waterbed mattress 4 is used. The last two embodiments of the present invention illustrate the versatility of the bed assembly 10. The bed assembly 10 can accommodate not only the firmness requirement of two individuals, but may also cater to the taste of two individuals who prefer different types of sleeping surfaces.

Figure 9:
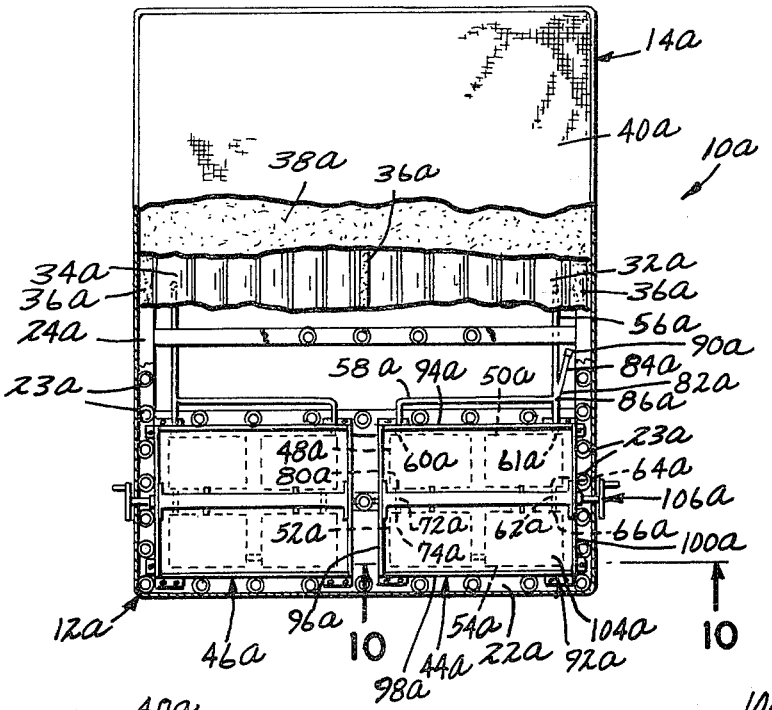
FIG. 9 is a top plan view of a second embodiment of a mechanism for adjusting the overall firmness of an air mattress.
Figure 10:
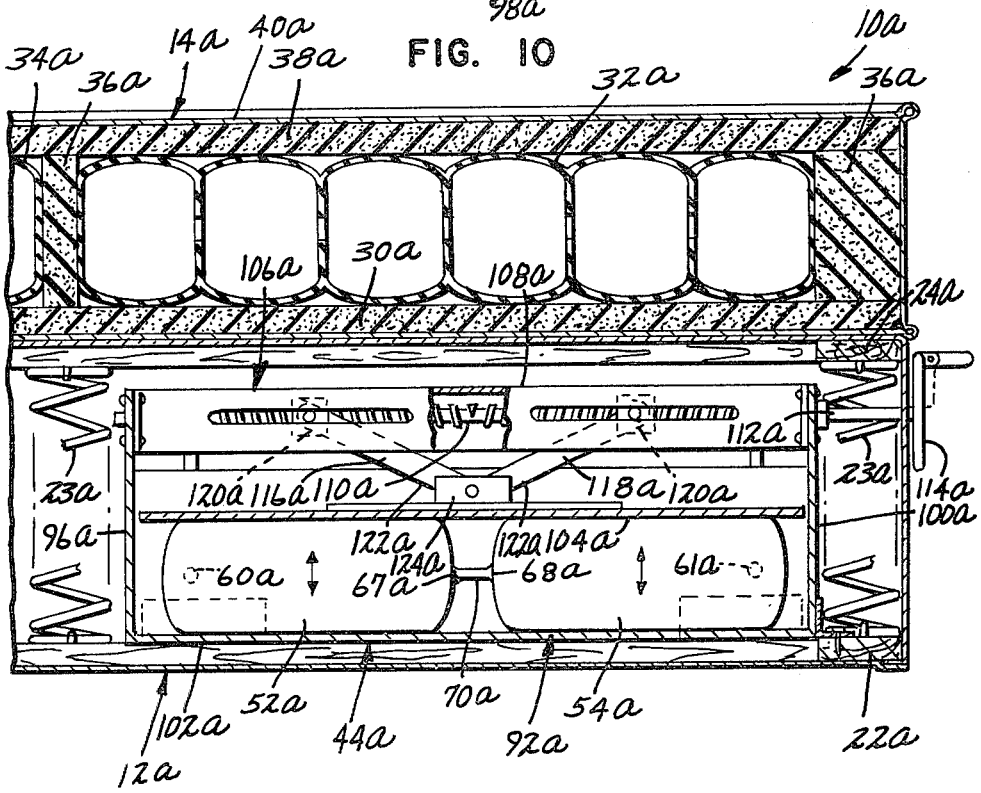
FIG. 10 is a view taken along lines 10—10 of FIG. 9 on an enlarged scale.
Figure 11:
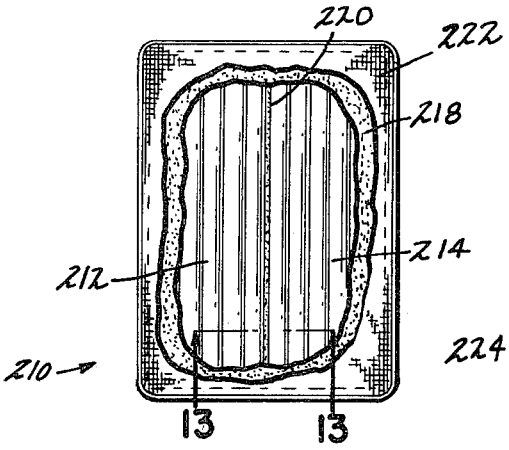
FIG. 11 is a top plan view of a mattress in accordance with an embodiment of the present invention.
Figure 12:
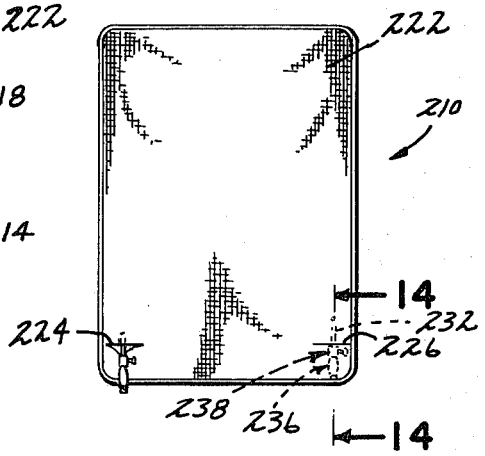
FIG. 12 is a bottom plan view of the subject matter of FIG. 11.
Figure 13:
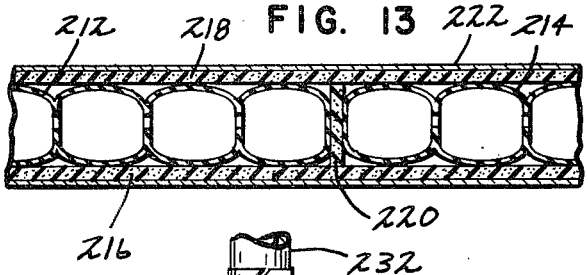
FIG. 13 is an enlarged sectional view of FIG. 11 taken along lines 13—13.

In another embodiment there is shown in FIGS. 9 and 10 a bed assembly in accordance with the present invention designated generally as **10*a*. The bed assembly 10*a* includes a support structure 12*a* and a body supporting section 14*a*. The support structure 12*a*** is preferably a standard box spring with some of its interior sections removed and replaced with firmness adjusting means as will be hereinafter explained.

The support structure 12*a* may include a base 22*a*. A top surface 24*a* of the support structure 12*a* supports the body support section 14*a*. Such a box spring may comprise a plurality of springs 23*a* extending from base 22*a* to top surface 24*a*.

The body supporting section 14*a* preferably includes a sheet of resilient material 30*a*, a first air mattress 32*a*, a second air mattress 34*a*, soft resilient material 36*a*, a second sheet of resilient material 38*a*, and a cover member 40*a*. The sheet of resilient material 30*a* is supported above the top surface 24*a*. The first and second air mattresses 32*a*, 34*a* are thereafter supported upon the sheet 30*a*. The air mattresses 32*a*, 34*a* are conventional in construction and preferably have a four-sided rectangular configuration. The mattresses 32*a*, 34*a* are arranged in a side-by-side relationship wherein one lateral side of the first air mattress 32*a* is disposed adjacent one lateral side of the second air mattress 34*a*. A perimeter boundary around the two air mattresses 32, 34 is formed by the other lateral sides and both of the top sides and both of the bottom sides of the air mattresses 32*a*, 34*a*. The soft resilient material 36*a* is supported atop the sheet 30*a* and surrounds the perimeter boundary of the first and second air mattresses 32*a*, 34*a* and extends between air mattresses 32*a*, 34*a*. The resilient material 36*a* is preferably made of four longitudinally extending blocks of material, such as foam rubber. The second sheet of resilient material 38*a* rests on top of the soft resilient material 36*a* and on top of the two air mattresses 32*a*, 34*a*. The sheets 30*a*, 38*a*, the air mattresses 32*a*, 34*a* and the soft resilient material 36*a* are all received within the cover member 40*a*. The cover member 40*a* may have a zipper (not shown) extending around at least a portion of its length so that the cover member 40*a* may be readily removed.

Each air mattress 32*a*, 34*a* is connected respectively to a discrete means 44*a*, 46*a* for adjusting the overall firmness of the respective air mattresses 32*a*, 34*a*. Discrete means 44*a*, 46*a* may be affixed to base 22*a* within the support structure 12*a*. Since the air mattresses 32*a*, 34*a* and the firmness adjusting means 44*a*, 46*a* are identical, only the air mattress 32*a* and the associated firmness adjusting means 44*a* will be described hereinater in detail.

The firmness adjusting means 44*a* includes a plurality of flexible balloons or bladders 48*a*, 50*a*, 52*a*, and 54*a* in fluid communication with the air mattress 32*a* via a conduit means 56*a*. The balloons 48*a*–54*a* are made of a strong flexible material capable of withstanding the pressures which will be exerted upon them. A plurality of balloons is utilized so that the total pressure will not be exerted upon any single balloon. The conduit means 56*a* is in fluid communication with balloon 50*a* via port 61*a* and includes an inlet-outlet tube 58*a* in fluid communication with balloon 48*a* via port 60*a*. An inlet-outlet tube 62*a* is connected in fluid communication with balloon 50*a* via port 64*a* and balloon 54*a* through port 66*a*. Balloons 52*a*, 54*a* are similarly connected in fluid communication to each other via tube 70*a* connected to balloon 52*a* at port 67*a* and port 68*a* in balloon 54*a*. Balloons 52*a* and 48*a* are connected in fluid communication by tube 72*a* connected to balloon 52*a* at port 74*a* and at balloon 48*a* at port 80*a*. A T-connecter 86*a* couples a tube 58*a* to the conduit means 56*a*. A Y-connector 82*a* is spliced into conduit means 56*a* and a tube 84*a* is attached to the remaining end of Y-connecter 82*a*. Tube 84*a* is used to fill the balloons 48*a*–54*a* and mattress 32*a* with a specified quantity of air by any suitable means. Thereafter the end of the tube 84*a* is sealed by any suitable means, such as cap 90*a*.

The balloons 48*a*–54*a* define chambers having variable internal volumes. When pressure is applied to the balloons 48*a*–52*a*, air is forced from the balloons 48*a*–52*a* through the conduit means 56*a*, and into the air mattress 32*a*. In this manner, the overall firmness of the air mattress 32*a* is increased. If the internal volume is held after the pressure is applied, the firmness remains at a set value. FIGS. 9 and 10 illustrate in detail a preferred pressure application means that is capable of holding the balloons 48*a*–54*a* at a set internal volume.

The balloons 48*a*–54*a* are held within a housing 92*a*. The housing 92*a* includes four upright side walls 94*a*, 96*a*, 98*a* and 100*a*, a base plate or wall 102*a* and a top plate or wall 104*a*. In order to apply pressure to the balloons 48*a*–54*a*, one of the walls 94*a*–104*a* is movable with respect to the other walls 94*a*–104*a*. Preferably the top wall 104*a* is made movable upwardly and downwardly with respect to the base wall 102*a*.

A scissor jack 106*a* is used to move the top wall 104*a* upwardly and downwardly. The scissor jack 106*a* has a support bar 108*a* which has opposite ends connected to the side walls 96*a* and 100*a*. A screw 110*a* is rotatably carried by the support bar 108*a*. A rod 112*a* is attached to one end of the screw 110*a* for rotary motion therewith. The rod 112*a* extends outwardly of the support structure 12*a* and has a handle 114*a* fixed to its distal end. By cranking the handle 114*a*, the rod 112*a* and the screw 110*a* can be rotated. A pair of linkage arms 116*a*, 118*a* are drivingly coupled to the screw 110*a*. Each linkage arm 116*a*, 118*a* has a first end 120*a* coupled to the screw 110*a* and a second end 122*a* pivotably connected to a block 124*a*. The block 124*a* is fixedly secured to the top wall 104*a*. The rotation of the screw 110*a* causes the ends 120*a* to move along the longitudinal axis of the screw 110*a* toward and away from one another. This causes the second end 122*a* to pivot within the block 124*a* and to thereby move the top wall 104*a* upwardly and downwardly. The top plate 104*a* and the linkage arms 116*a*, 118*a* are shown in an upward disposition in FIG. 10. An electric motor such as that described in the embodiment shown in FIGS. 1–6 can be coupled to the rod 112*a* in place of the handle 114*a*. Such an electric motor could be supported within or outside of the support structure 12*a*. A motorized, instead of a manual, firmness adjusting means would thus be provided. A firmness indicating system such as the one shown in FIGS. 4 and 8 of a previously described embodiment could also be added to this embodiment.

By moving the plate 104*a* upwardly and downwardly, the set quantity of air within the balloons 48*a*–54*a* and the air mattress 32*a* can be transferred therebetween. The overall firmness of the air mattress 32*a* can thereby be adjusted. Since the scissor jack 106*a* will hold the top wall 104*a* in a set position, the overall firmness of the air mattress 32*a* is also set. Means may be provided for indicating the relative overall firmness of the air mattress 32*a*.

Another embodiment of this invention is shown in FIGS. 11–15. A bed assembly 210 is shown from the top FIG. 13 including a pair of air mattresses 212 and 214 lying essentially side by side. Underneath and above mattresses 212 and 214 are preferably sheets of resilient material 216 and 218 respectively. A strip of resilient material 217 preferably surrounds the outer perimeter of mattresses 212 and 214 joining the resilient material 216 and 218 to form a completely resilient covering around the mattresses. The mattresses may also include a further resilient strip 220 located at a point between the two mattresses. The entire mattress encased in sheets of resilient material is received within a cover member 222 having a zipper opening (not shown) for insertion or removal of the mattresses. Cover 222 contains a pair of apertures or slits 224 and 226 which form pocket-like openings in cover 222 which overlap. The ends of the over-lapping sections 228 and 230 are folded over and sewn so as to reinforce the opening. This opening in cover 222 provides a means for removing the hand pump as will be hereinafter described. The apertures 224, 226 are preferably located in the corners of the mattresses in order to afford easy accessibility to the user.

Figure 14:
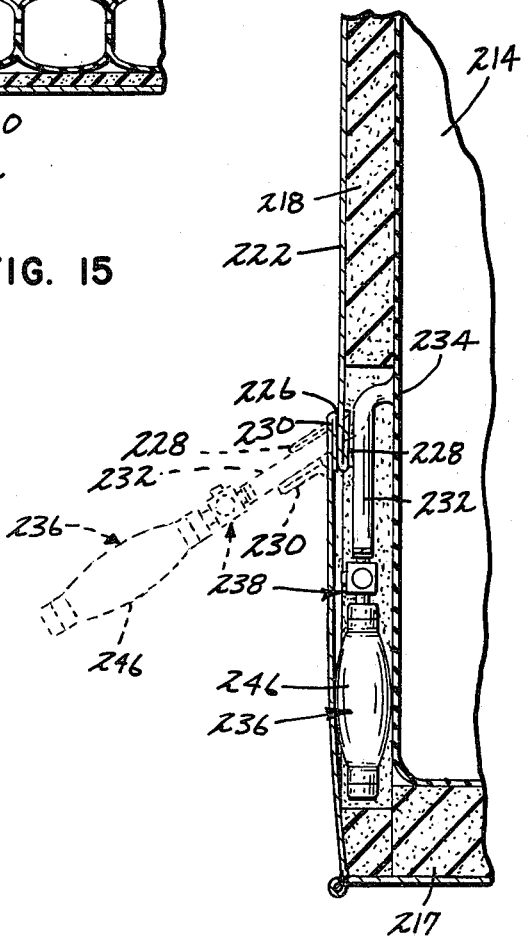
FIG. 14 is an enlarged sectional view of FIG. 12 taken along line 14—14 showing a hand pump in two positions.
Figure 15:
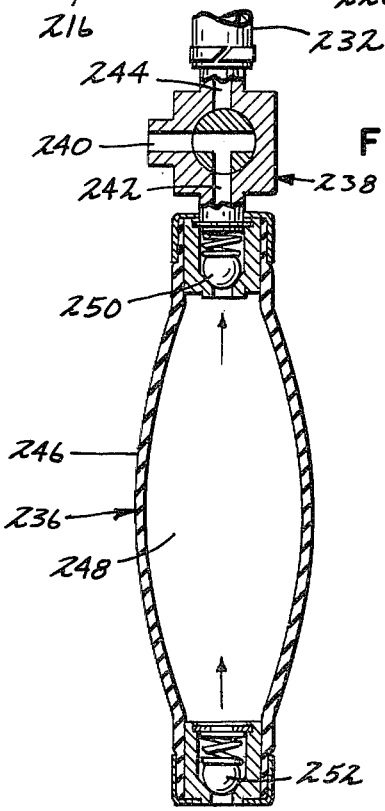
FIG. 15 is an enlarged view of a hand pump in section with portions broken away.

Since mattresses 214 and 212 are substantially identical mirror images of each other, only mattress 214 will be discussed in detail. Mattress 214 contains a conduit means 232 extending from the outer surface of mattress 214 through a port 234. Conduit means 232 is connected to a pressure regulating means such as pump 236. Pump 236 may be any pumping device, hand or electromechanically operated. The preferred pump 236 is of a standard variety hand squeeze pump. Pump 236 is shown in FIG. 14 in solid lines in its storage position between cover 222 and mattress 226, and in its pumping position in phantom lines, extending through the slit 226 outside of the cover 222. Hand pump 236 is shown in greater detail in FIG. 15. Conduit means 232 is connected to a 3-position valve 238 having an exit port 240 for exhausting air from the system and an entrance port 242 for adding air to the system. Port 244 connects the 3-position valve to conduit means 232. A control or valve 238 (not shown) permits the operator to select a connection between port 240 and port 244 to permit air to be exhausted from mattress 226 through conduit means 232 and out port 240, thus deflating the mattress. The operator may also select the position in the valve which permits a connection of ports 244 and 242, which are used to pump up the mattress. The operator may also select the position in the value which seals port 244, as shown in FIG. 15, in order to provide a positive seal against leakage from the air mattress. The valve at port 242 is connected to the pumping bulb 246 which includes a flexible bulb section 248 and ball check valve 250 at the output end of bulb section 248 which is connected to port 242. A ball check valve 252 is located at the suction end (away from valve 238) of bulb section 248 and permits air to be drawn into the ball section 248 but prevents air from escaping that end of the bulb. Instead, when the bulb section 248 is squeezed air is forced out through the bulb check valve 250, but valve 250 prevents escape of air in the opposite direction.

To operate the bed assembly, pump 236 is extended through the slit 226 so that pump 236 is outside of the cover 222. The user then selects the position on the valve 238 whhich connects ports 242 and 244. The bulb 248 is then repeatedly squeezed until the mattress is pressurized to the proper firmness. When pumped up to desired pressure, valve 238 is operated so that port 244 is sealed as shown in FIG. 15. To reduce the pressure, valve 283 is operated so that ports 240 and 244 are in communication, thereby allowing an outflow of air. Pump 236 is then returned to its storage position in a pocket formed by cover 222, resilient material 218, and air mattress 214.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A bed assembly comprising:

an air mattress for supporting a human body, said air mattress having an overall firmness determined by the quantity of air in said air mattress and a port for admitting and releasing air to and from said air mattress;

box spring means for resiliently supporting said air mattress above a surface; and means for adjusting the overall firmness of said air mattress by adjusting the amount of air in said air mattress;

said adjusting means including at least one chamber defining a variable internal volume for containing a variable quantity of air, said at least one chamber being located within said box spring means, conduit means connecting said chamber with the port of said air mattress for fluid communication between said chamber and said air mattress, and means for changing the internal volume of said chamber and for setting the internal volume at a desired internal volume whereby a desired overall air mattress firmness is established by adjusting and setting the relative quantity of air in said air mattress and in said chamber.

2. A bed assembly in accordance with claim 1 including a plurality of said chambers, said conduit means including an individual inlet-outlet tube connected to an inlet-outlet port of each chamber and a transfer tube connected to each of said inlet-outlet tubes and to the port of said air mattress whereby fluid communication is established between each of said chambers and said air mattress.

3. A bed assembly in accordance with claim 1 wherein said chamber is comprised of a flexible walled balloon, and said volume changing means includes means for applying pressure to said balloon.

4. A bed assembly in accordance with claim 2 wherein each of said chambers is comprised of a flexible walled balloon, and said volume changing means includes means for applying pressure to each of said balloons.

5. A bed assembly in accordance with claim 4 wherein said volume changing means includes a pair of walls between which said balloons are supported and a means for moving one of said walls relative to the other wall.

6. A bed assembly in accordance with claim 5 wherein one of said walls is a base plate for supporting said balloons and the other of said walls is a top plate supported spaced from and above said base plate.

7. A bed assembly in accordance with claim 6 wherein said moving means is coupled to said top plate for moving said top plate upwardly and downwardly relative to said base plate.

8. A bed assembly in accordance with claim 6 wherein said volume changing means includes upright side walls surrounding said base plate and said top plate and said moving means is supported by said side walls and is coupled to said top plate for moving said top plate upwardly and downwardly relative to said base plate.

9. A bed assembly in accordance with claim 8 wherein said moving means is comprised of a scissor jack having a support bar, a screw supported for rotary motion by said bar, a rod connected to said screw for rotation therewith, and a pair of linkage arms drivingly coupled to said screw, said support bar having opposite ends, each of said ends being attached to one of said side walls, each linkage arm having a first end drivingly coupled to said screw and a second end pivotally connected to said top plate whereby the rotation of said screw changes the distance between said first ends of said linkage arms to thereby raise or lower said top plate.

10. A bed assembly in accordance with claim 9 including a crank handle attached to said rod.

11. A bed assembly in accordance with claim 9 including a drive motor connected to said rod for rotatably driving said rod and screw.

12. A bed assembly in accordance with claim 9 including means for indicating the overall firmness of said air mattress, said indicating means including means for determining the location of said top plate relative to said bottom plate.

13. A bed assembly in accordance with claim 12 wherein said determining means includes a pair of microswitches attached to said support bar, each microswitch having a control arm disposed for activation by the first end of one of said linkage arms.

14. A bed assembly in accordance with claim 1 including means for indicating the overall firmness of said mattress.

15. A bed assembly comprising:

a box spring support structure including a resilient top surface and deformable wall means supporting said top surface;

at least one air mattress supported on top of said box spring, said air mattress having an overall firmness determined by the quantity of air in said mattress and a port for admitting and releasing air to and from said air mattress;

means for adjusting the overall firmness of said air mattress by adjusting the amount of air in said air mattress;

said adjusting means including at least one flexible walled balloon, conduit means for connecting in fluid communication said balloon with said port of said air mattress, and means for applying pressure to said balloon to transfer air between said balloon and said air mattress;

said pressure application means including a housing with a top wall, a bottom wall, a plurality of upright side walls, and means for moving one of said walls relative to the other walls, said moving means including means for holding said movable wall at a fixed position after a desired overall firmness is selected, said housing being supported below and within the outer perimeter of said box spring support structure.

16. A bed assembly in accordance with claim 15 wherein said adjusting means includes a set of said at least one balloon.

17. A bed assembly in accordance with claim 15 including a second air mattress supported on top of said top surface in a side-by-side relationship to said first air mattress, said second air mattress having a second port for admitting and releasing air to and from said second air mattress, second discrete means for adjusting the overall firmness of said second air mattress by adjusting the amount of air in said second air mattress, said second adjusting means including a second flexible walled balloon, second conduit means for connecting in fluid communication said second balloon with said port of said second air mattress and second means for applying pressure to said second balloon to transfer air between said second balloon and said second air mattress, said second pressure application means including a second housing having a second top wall, a second bottom wall, second upright side walls and second means for moving one of said second walls relative to the other second walls, said second housing being supported below and within the outer perimeter of said box spring.

18. A bed assembly in accordance with claim 17 wherein said second adjusting means include a set of second balloons.

19. A bed assembly in accordance with claim 17 wherein each moving means is connected to a respective top wall for moving the respective top of wall relative to an associated bottom wall.

20. A bed assembly in accordance with claim 19 wherein each moving means includes a scissor jack having a support bar, a screw supported for rotary motion by said bar, a rod connected to said screw for rotary motion therewith, and a pair of linkage arms drivingly coupled to said screw, said support bar having opposite ends, each of said ends being attached to one of said side walls, each linkage arm having a first end drivingly coupled to said screw and a second end pivotally connected to said top wall whereby the rotation of said rod and said screw change the distance between said first ends of said linkage arms to thereby raise or lower one of said top plates.

21. A bed assembly in accordance with claim 20 including a discrete drive motor connected to each of said rods for independently driving each of said screws.

22. A bed assembly in accordance with claim 20 wherein each rod extends outward of said outer perimeter of said box spring to an aperture therethrough, and a discrete crank handle connected to each of said rods at a location outside of said support structure.

23. A bed assembly in accordance with claim 20 including discrete indicating means for indicating the overall firmness of each of said air mattresses, each indicating means including a plurality of lights indicative of the relative firmness of an air mattress and means for determining the location of one of said top walls relative to a respective bottom wall and for lighting one of the said lights dependent upon the location of said top wall.

24. A bed assembly in accordance with claim 23 wherein each determining means includes a pair of microswitches supported adjacent to said support bar, each of said microswitches having a control arm, said control arms being disposed so that the motion of one of said first ends of a linkage arm can activate said control arms.

25. A bed assembly in accordance with claim 15 wherein said air mattress has a generally four-sided rectangular configuration, and wherein soft resilient material surrounds the four sides of said air mattress, a sheet of soft resilient material extending across the top of said air mattress, and a cover member surrounding said soft resilient materials and said air mattress.

26. A bed assembly in accordance with claim 17 wherein each of said air mattresses has a generally rectangular configuration having a top side, a bottom side, and a pair of lateral sides, said air mattress being arranged in a side-by-side relationship wherein one of the lateral sides of a first of said air mattresses is disposed adjacent one of the lateral sides of a second of said air mattresses and a perimeter boundary of said air mattresses is formed by the other lateral sides, both of the top sides and both of the bottom sides, said perimeter boundary being surrounded by soft resilient material, a sheet of soft resilient material covering a top surface of both of said air mattresses, and a cover member surrounding said soft resilient materials, and both of said air mattresses.

27. A bed assembly in accordance with claim 26 including a strip of soft resilient material having a generally T-shaped cross section with a top member and a downwardly extending member, the downwardly extending member being disposed between said two air mattresses.

28. A bed assembly in accordance with claim 15 including a spring-type mattress supported on top of said box spring support structure in a side-by-side relationship to said air mattress.

29. A bed assembly in accordance with claim 15 including a water-bag mattress supported on top of said box spring support structure in a side-by-side relationship to said air mattress.

30. A bed assembly in accordance with claim 15 including a foam-type mattress supported on top of said box spring support structure in a side-by-side relationship to said air mattress.

31. A box spring assembly for use with an air mattress assembly comprising:

a box spring for resiliently supporting the air mattress including a bottom surface, a top surface, deformable side walls and a plurality of springs supported between said top and bottom surface;

means located within the box spring for adjusting the overall firmness of the air mattress by adjusting the amount of air in said air mattress;

said adjusting means including a set of flexible walled balloons, conduit means for connecting in fluid communication each of said balloons with a port of the air mattress, and means for applying pressure to said balloons to transfer air between said balloons and the air mattress;

said pressure application means including a housing with a top wall, bottom wall, a plurality of upright side walls, and means for moving one of said walls relative to the other walls, said moving means including means for holding said movable wall at a fixed position and exerting a fixed pressure on said balloons whereby a desired overall firmness in the mattress is selected, said housing being supported below the top surface of said box spring and within the outer perimeter of the box spring.

* * * * *